US008393090B2

(12) United States Patent
Kang

(10) Patent No.: US 8,393,090 B2
(45) Date of Patent: Mar. 12, 2013

(54) CLOTHES DRYER WITH WATER TANK

(75) Inventor: Min Hee Kang, Busan (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 524 days.

(21) Appl. No.: 12/457,943

(22) Filed: Jun. 25, 2009

(65) Prior Publication Data

US 2010/0058605 A1 Mar. 11, 2010

(30) Foreign Application Priority Data

Sep. 10, 2008 (KR) ..... 10-2008-89128

(51) Int. Cl.
*F26B 19/00* (2006.01)

(52) U.S. Cl. ..... 34/85; 34/595; 34/606; 68/12.04; 68/12.06

(58) Field of Classification Search ..... 34/85, 595, 34/601, 602, 606, 610; 68/12.04, 12.06
See application file for complete search history.

(56) References Cited

U.S. PATENT DOCUMENTS

| | | | | | |
|---|---|---|---|---|---|
| 1,775,699 | A | * | 9/1930 | Silver | 8/142 |
| 2,316,669 | A | * | 4/1943 | Busi | 68/20 |
| 2,742,708 | A | | 4/1956 | McCormick | |
| 3,387,385 | A | * | 6/1968 | Mandarino, Jr. et al. | 34/596 |
| 3,388,567 | A | * | 6/1968 | Oles | 68/18 R |
| 3,392,455 | A | * | 7/1968 | Kingsbaker, Jr. et al. | 34/405 |
| 3,395,634 | A | * | 8/1968 | Smith, Jr | 99/483 |
| 3,400,465 | A | * | 9/1968 | Von Stroh | 34/443 |
| 3,401,466 | A | * | 9/1968 | Brewster | 34/92 |
| 3,516,174 | A | * | 6/1970 | Behrens | 34/534 |
| 3,585,731 | A | * | 6/1971 | Wayne | 4/471 |
| 3,589,025 | A | * | 6/1971 | Hamerski | 34/468 |
| 3,599,554 | A | * | 8/1971 | Aelterman et al. | 430/30 |
| 3,605,273 | A | * | 9/1971 | Anderson | 4/408 |
| 3,616,542 | A | * | 11/1971 | Rader | 34/287 |
| 3,648,379 | A | * | 3/1972 | Mercer et al. | 34/284 |
| 3,651,580 | A | * | 3/1972 | Meyer | 34/602 |
| 3,660,910 | A | * | 5/1972 | Evans et al. | 34/60 |

(Continued)

FOREIGN PATENT DOCUMENTS

| | | | |
|---|---|---|---|
| EP | 0 731 203 | | 9/1996 |
| EP | 789105 | A1 * | 8/1997 |

(Continued)

OTHER PUBLICATIONS

European Search Report for corresponding European Application 09156900.4-2314; dated Nov. 17, 2009.

*Primary Examiner* — Stephen M. Gravini
(74) *Attorney, Agent, or Firm* — Staas & Halsey LLP

(57) ABSTRACT

A clothes dryer having an improved configuration to allow a user to safely pull out a water tank is disclosed. The clothes dryer includes a body having a water tank housing, a water tank detachably mounted into the water tank housing and serving to store water collected from an object to be dried, and a safety guide to limit movement of the water tank in a first direction when the water tank is separated from the water tank housing in the first direction, so as to allow a user to guide movement of the water tank in a second direction. The safety guide includes a first stopper provided at the water tank housing, and a second stopper provided at the water tank to correspond to the first stopper when the water tank is separated in the first direction.

18 Claims, 8 Drawing Sheets

U.S. PATENT DOCUMENTS 3,681,851 A * 8/1972 Fleming ..... 34/291
3,703,274 A * 11/1972 Davis ..... 432/66
3,714,719 A * 2/1973 Wayne ..... 34/74
3,728,797 A * 4/1973 Worden et al. ..... 34/468
3,739,496 A * 6/1973 Buckley et al. ..... 34/210
3,767,300 A * 10/1973 Brown et al. ..... 399/250
3,807,054 A * 4/1974 Joseph et al. ..... 34/73
3,831,288 A * 8/1974 Stribling et al. ..... 34/259
3,850,224 A * 11/1974 Vidmar et al. ..... 164/456
3,884,213 A * 5/1975 Smith ..... 126/21 A
4,001,945 A * 1/1977 Aurich et al. ..... 34/635
4,015,341 A * 4/1977 McKinney et al. ..... 34/263
4,027,401 A * 6/1977 Fairbanks, Jr. ..... 34/410
4,112,590 A * 9/1978 Muller ..... 34/75
4,125,946 A * 11/1978 Prager ..... 34/80
4,126,519 A * 11/1978 Murray ..... 201/32
4,127,947 A * 12/1978 Webb et al. ..... 34/92
4,130,456 A * 12/1978 Itoh et al. ..... 159/16.3
4,154,002 A * 5/1979 Moore ..... 34/390
4,154,003 A * 5/1979 Muller ..... 34/469
4,154,861 A * 5/1979 Smith ..... 426/466
4,176,467 A * 12/1979 Brookhyser ..... 34/236
4,186,495 A * 2/1980 Remberg et al. ..... 34/92
4,188,730 A * 2/1980 Allen et al. ..... 34/380
4,188,733 A * 2/1980 Brookhyser ..... 34/236
4,189,851 A * 2/1980 Brookhyser ..... 34/236
4,192,079 A * 3/1980 Brookhyser et al. ..... 34/380
4,193,207 A * 3/1980 Allen et al. ..... 34/380
4,240,210 A * 12/1980 Huang ..... 34/520
4,281,465 A * 8/1981 Zimmermann et al. ..... 34/468
4,290,908 A * 9/1981 Horiuchi et al. ..... 588/2
4,296,072 A * 10/1981 Takacs et al. ..... 422/254
4,311,670 A * 1/1982 Nieminen et al. ..... 422/145
4,319,410 A * 3/1982 Heilhecker et al. ..... 34/75
4,338,911 A * 7/1982 Smith ..... 126/21 A
4,347,670 A * 9/1982 Wear et al. ..... 34/263
4,389,794 A * 6/1983 Bitterly ..... 34/287
4,409,453 A * 10/1983 Smith ..... 219/684
4,413,425 A * 11/1983 Candor ..... 34/251
4,455,135 A * 6/1984 Bitterly ..... 432/1
4,502,227 A * 3/1985 Janusch ..... 34/380
4,553,339 A * 11/1985 Rigo ..... 34/99
4,566,205 A * 1/1986 Schlagel ..... 34/232
4,585,463 A * 4/1986 Hirose ..... 48/111
4,609,430 A * 9/1986 Okamoto ..... 159/29
4,615,122 A * 10/1986 Sherrod et al. ..... 34/422
4,665,628 A * 5/1987 Clawson ..... 34/449
4,685,220 A * 8/1987 Meenan et al. ..... 588/320
4,689,896 A * 9/1987 Narang ..... 34/82
4,694,588 A * 9/1987 Bagolin et al. ..... 34/77
4,698,917 A * 10/1987 Debolini ..... 34/92
4,699,048 A * 10/1987 Pavan ..... 99/470
4,715,965 A * 12/1987 Sigerson et al. ..... 210/511
4,753,016 A * 6/1988 Eichholz ..... 34/86
4,769,249 A * 9/1988 Webb ..... 426/438
4,778,606 A * 10/1988 Meenan et al. ..... 210/771
4,784,216 A * 11/1988 Bracegirdle et al. ..... 165/64
4,787,323 A * 11/1988 Beer et al. ..... 110/346
4,793,937 A * 12/1988 Meenan et al. ..... 210/771
4,800,655 A * 1/1989 Mori et al. ..... 34/77
2006/0080974 A1 * 4/2006 Ono et al. ..... 62/93
2007/0113421 A1 * 5/2007 Uhara et al. ..... 34/275
2007/0169367 A1 * 7/2007 Tadano ..... 34/77
2008/0141550 A1 * 6/2008 Bae et al. ..... 34/68

FOREIGN PATENT DOCUMENTS

EP 1 548 177 6/2005
EP 2163681 A1 * 3/2010
JP 01284298 A * 11/1989
JP 10-2006-0085969 7/2006

* cited by examiner

CLOTHES DRYER WITH WATER TANK

CROSS-REFERENCE TO RELATED APPLICATIONS

This application claims the benefit of Korean Patent Application No. 2008-0089128, filed on Sep. 10, 2008 in the Korean Intellectual Property Office, the disclosure of which is incorporated herein by reference.

BACKGROUND

1. Field

The present invention relates to a clothes dryer, and, more particularly, to a clothes dryer capable of preventing a user accident when pulling out a water tank.

2. Description of the Related Art

A clothes dryer is an apparatus that blows hot air into a drying vessel to dry an object received in the drying vessel. Generally, a clothes dryer may be classified as an exhaust-type dryer to exhaust hot and humid air having passed through a drying vessel out of the dryer, and a condensing-type dryer to remove moisture from hot and humid air and recirculate the air into a drying vessel.

A clothes dryer incorporates a water tank that is selectively detachable if necessary. The water tank is used to store water collected from an object to be dried. When the water tank is filled with more than a predetermined level of water, the water tank is manually separated from the dryer and then, is again inserted into the dryer after discharge of the filled water.

If a user is not cautious when pulling out the water tank, the weight of the water tank may suddenly act on the user when the water tank is separated from the dryer, making it impossible for the user to properly support the water tank.

SUMMARY

Accordingly, it is an aspect of the embodiments to provide a clothes dryer having an improved configuration to allow a user to safely pull out a water tank.

Additional aspects and/or advantages of the invention will be set forth in part in the description which follows and, in part, will be obvious from the description, or may be learned by practice of the invention.

The foregoing and/or other aspects are achieved by providing a clothes dryer, including: a body having a water tank housing; a drying unit heating air to be circulated within the body to dry an object; a water tank detachably mounted into the water tank housing and storing water collected from the object to be dried; and a safety guide limiting movement of the water tank in a first direction when the water tank is separated from the water tank housing in the first direction, so as to allow a user to guide movement of the water tank in a second direction.

The safety guide may include a first stopper provided at the water tank housing, and a second stopper provided at the water tank to correspond to the first stopper when the water tank is separated from the water tank housing in the first direction.

The first stopper may be formed at a bottom surface of the water tank housing, and the second stopper may be formed at a lower surface of the water tank.

The water tank housing may include a housing entrance through which the water tank enters or exits, and the first stopper may be positioned adjacent to the housing entrance.

The second stopper may be positioned opposite the housing entrance.

The safety guide may include a protrusion protruding from the water tank toward the water tank housing, and a least one indentation to be engaged with the protrusion to limit movement of the water tank.

A first indentation may be formed at an position substantially adjacent to an entrance of the water tank housing and a second indentation may be formed at a back portion of the water tank housing with respect to an entrance of the water tank housing.

The second indentation may be a seating recess configured to receive the protrusion when the water tank is not separated from the water tank housing in the first direction, the seating recess preventing the water tank from tilting.

The foregoing and/or other aspects are achieved by providing a clothes dryer, including: a body having a water tank housing; a rotating drum rotatably installed in the body and configured to receive an object to be dried; a drying unit to heat air and circulate the heated air through the rotating drum; a condenser disposed on a circulating route of the heated air and serving to condense moisture contained in the air; a cooling unit to supply cooling air to the condenser; a water tank detachably mounted into the water tank housing and serving to store condensate water; and a safety guide to guide the water tank to a predetermined position with respect to the water tank housing.

After the water tank is moved to the predetermined position, the safety guide allows a user to pull out the water tank in a state of lifting the water tank upward without causing the weight of the water tank to be applied to the user.

The safety guide may include an indentation formed in at least one of the water tank housing and the water tank.

The indentation may be formed in a bottom surface of the water tank housing, and the water tank may include a protrusion formed at a lower surface of the water tank to correspond to the indentation.

The safety guide may include a protrusion formed on at least one of the water tank housing and the water tank.

The safety guide may include a first protrusion formed at a bottom surface of the water tank housing, and a second protrusion formed at a lower surface of the water tank.

The foregoing and/or other aspects are achieved by providing a clothes dryer, including: a drying unit heating air to be circulated within the dryer to dry an object; a water tank housing; a water tank detachably mounted into the water tank housing; an indentation formed in a bottom surface of the water tank housing at a position adjacent to an entrance of the water tank housing; and a protrusion formed on a lower surface of the water tank and configured to be engaged with the indentation when the water tank is separated from the water tank housing in one direction.

The foregoing and/or other aspects are achieved by providing a clothes dryer, including: a drying unit heating air to be circulated within the dryer to dry an object; a water tank housing; a water tank detachably mounted into the water tank housing; a first protrusion provided at a bottom surface of the water tank housing at a position adjacent to an entrance of the water tank housing; and a second protrusion formed at a lower surface of the water tank and configured to interfere with the first protrusion when the water tank is separated from the water tank housing in one direction.

The foregoing and/or other aspects are achieved by providing a dryer, including: a drying unit heating air to be circulated within the dryer to dry an object; a water tank housing; a water tank detachably mounted in the water tank housing to hold water, the water tank housing preventing the water tank housing from becoming completely disengaged in a first direction when the water tank housing is pulled out from within the water tank housing in the first direction.

BRIEF DESCRIPTION OF THE DRAWINGS

These and/or other aspects and advantages of the embodiments will become apparent and more readily appreciated from the following description of the embodiments, taken in conjunction with the accompanying drawings, of which.

DETAILED DESCRIPTION OF EMBODIMENTS

Figure 1:
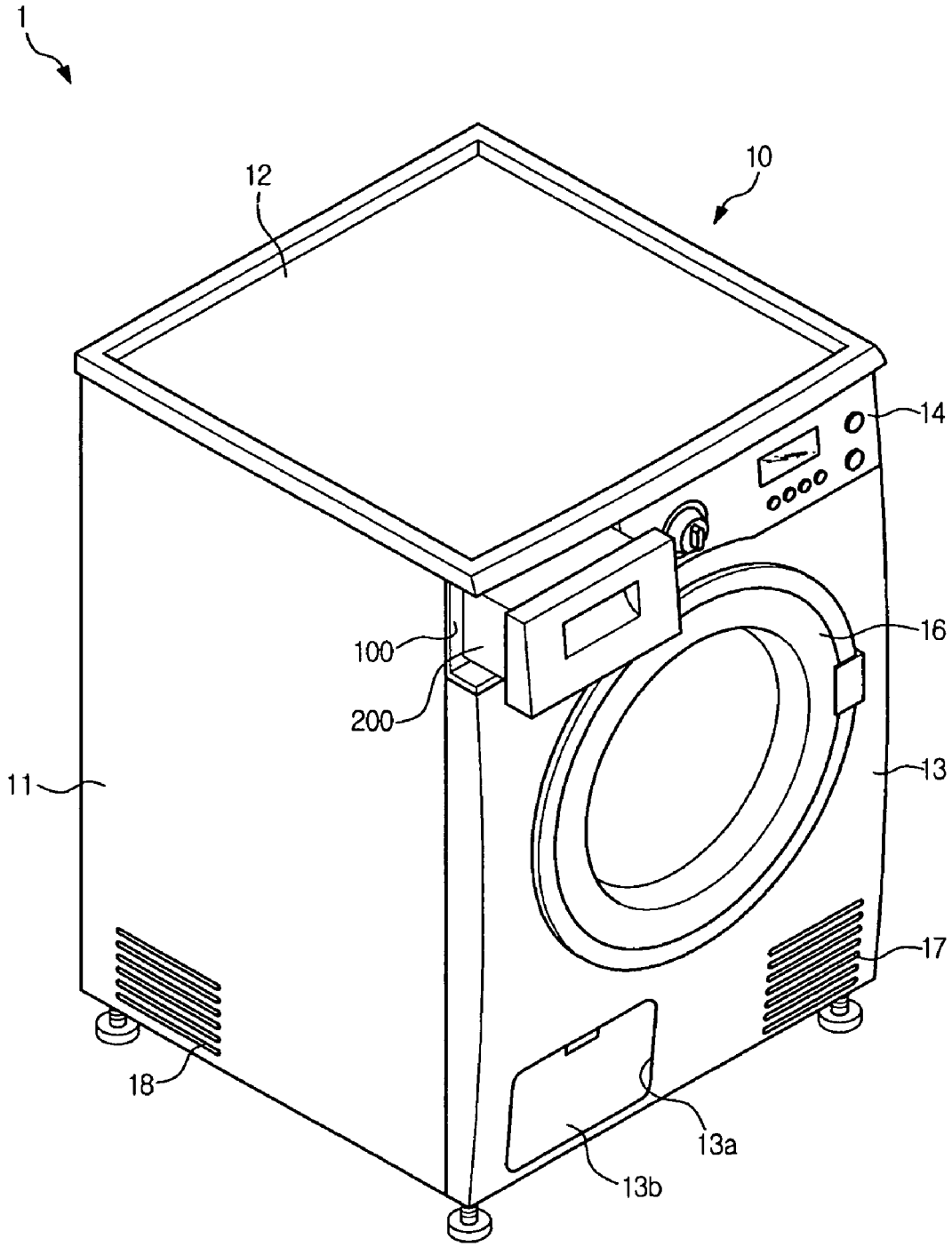
FIGS. 1 and 2 are views illustrating an outer appearance and inner configuration of a clothes dryer in accordance with an embodiment.

Reference will now be made in detail to the embodiments, examples of which are illustrated in the accompanying drawings, where like reference numerals refer to like elements throughout. The embodiments are described below to explain the present invention by referring to the figures.

Figure 2:
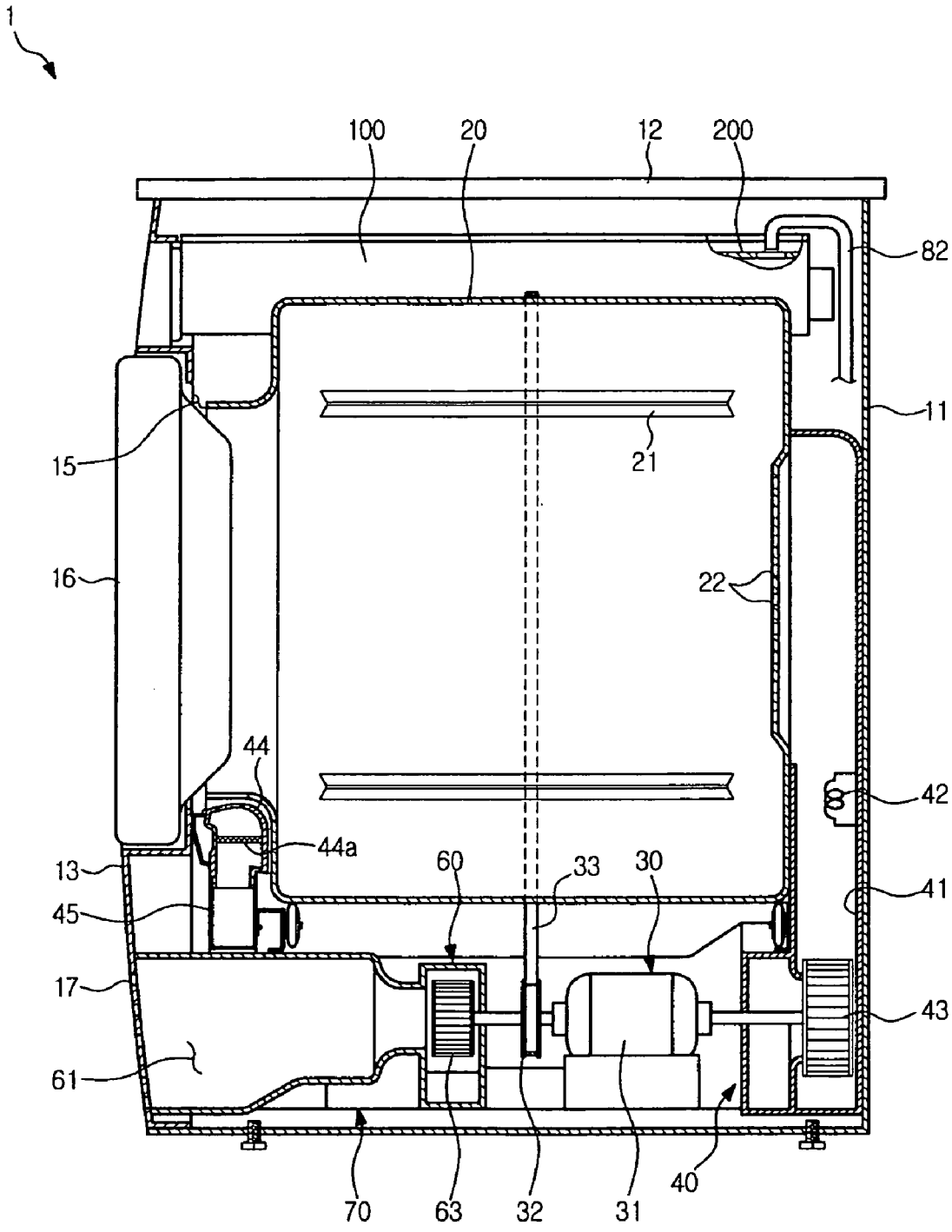
Figure 3:
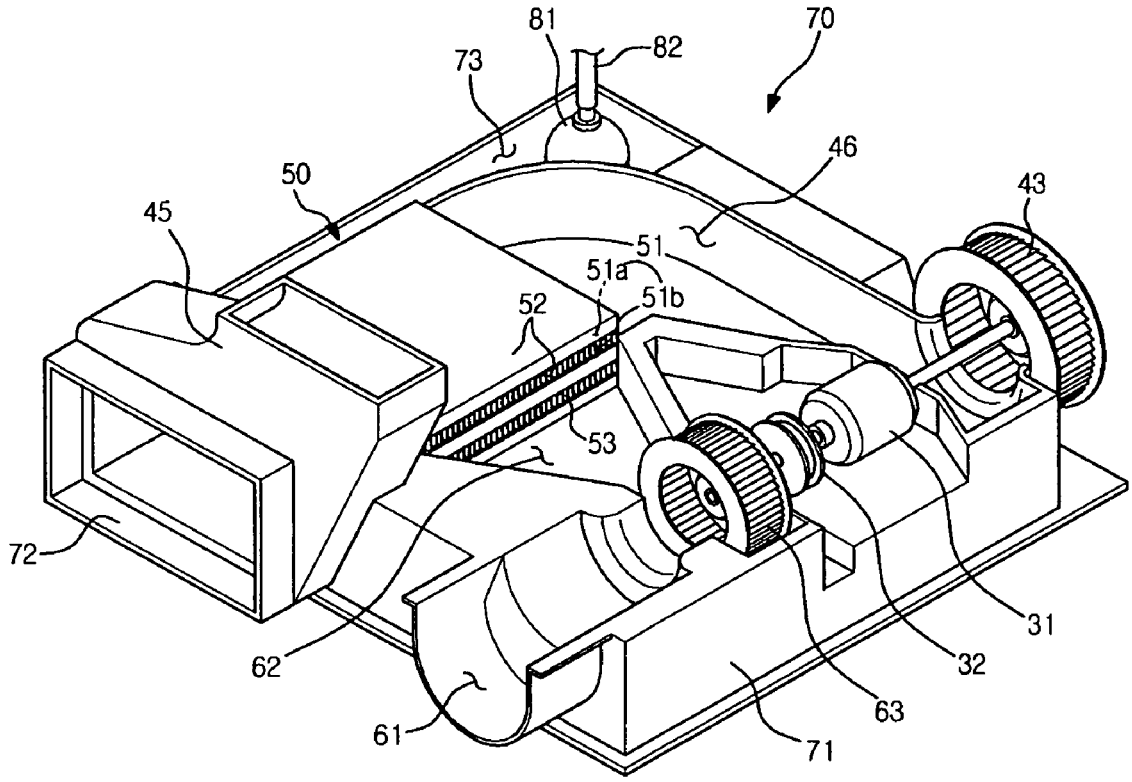
FIG. 3 is a view illustrating a base assembly of the clothes dryer in accordance with the embodiment.

FIGS. 1 and 2 are views illustrating an outer appearance and inner configuration of a clothes dryer in accordance with an embodiment, and FIG. 3 is a view illustrating a base assembly of the clothes dryer in accordance with the embodiment.

As shown in FIGS. 1 to 3, the clothes dryer 1 includes a body 10, a rotating drum 20, a drive unit 30, a drying unit 40, a condenser 50, a cooling unit 60, and a water tank 200.

The body 10 may include a cabinet 11, a top cover 12 to cover the top of the cabinet 11, a front panel 13 provided at a front side of the cabinet 11, a water tank housing 100 to receive the water tank 200, and a control panel 14 containing a variety of buttons or any other type of input device to control the dryer 1 and a display. In the present embodiment, although the water tank housing 100 and control panel 14 are integrated with each other via a single frame, the water tank housing 100 and control panel 14 may be provided separately.

The body 10 has an opening 15 at the front side thereof, through which an object to be dried can be put into the rotating drum 20. A door 16 is hingedly coupled to the opening, to open or close the opening 15.

The rotating drum 20 is rotatably installed in the body 10. The rotating drum 20 contains a plurality of lifters 21 arranged in a circumferential direction thereof. The lifters 21 serve to raise or drop the object to be dried, facilitating effective drying of the object.

The rotating drum 20 has an open front side, and hot air inlet holes 22 are perforated in a rear wall of the rotating drum 20. Air heated by the drying unit 40 is introduced into the rotating drum 20 through the hot-air inlet holes 22.

As shown in FIGS. 2 and 3, a base assembly 70 is mounted to a lower end of the rotating drum 20. The base assembly 70 includes a base 71 having flow-paths 46, 61 and 62 defined therein, and at least one base cover (not shown) to cover the base 71. The not shown at least one base cover is configured to cover the condenser 50, a cooling fan 63, and the flow-paths 46, 61 and 62 to construct a duct structure along with the base 71.

The rotating drum 20 is driven by the drive unit 30. As shown in FIGS. 2 and 3, the drive unit 30 may include a drive motor 31 mounted on the base assembly 70, a pulley 32 to be rotated by the drive motor 31, and a belt 33 to connect the pulley 32 and rotating drum 20 to each other to transmit power of the drive motor 31 to the rotating drum 20.

The drying unit 40 serves to heat air and circulate the heated air to dry the object to be dried within the rotating drum 20. The drying unit 40 may include a heating duct 41, a heater 42, a circulating fan 43, a hot-air discharge-duct 44, a connecting duct 45, and the flow-path 46, i.e. a hot-air circulating-path.

The heating duct 41 is arranged at the rear side of the rotating drum 20 and is in communication with the interior of the rotating drum 20 via the hot-air inlet holes 22 of the rotating drum 20. The heating duct 41 is also in communication with the hot-air circulating-path 46.

The heater 42 and circulating fan 43 are arranged in the heating duct 41. The heater 42 is used to heat air. The circulating fan 43 is used to suction air from the hot-air circulating-path 46 and discharge the suctioned air into the heating duct 41, creating airflow circulating through the rotating drum 20. The circulating fan 43 may be driven along with the rotating drum 20 by the drive motor 31.

The hot-air discharge duct 44 may be arranged at the front side of the rotating drum 20 and is used to guide the discharge of hot and humid air having passed through the interior of the rotating drum 20. The hot-air discharge duct 44 may be installed with a filter 44*a* to remove lint and other foreign matter.

The connecting duct 45 connects the hot-air discharge duct 44 and hot-air circulating-path 46 to each other, and the hot-air circulating-path 46 connects the connecting duct 45 and heating duct 41 to each other, for circulation of hot air. As shown in FIG. 3, the connecting duct 45 and the hot-air circulating-path 46 may be integrated with the base assembly 70.

The condenser 50 is arranged in the hot-air circulating-path 46 and is used to remove moisture from the circulating hot air. The hot air is cooled by relatively cold air supplied from the cooling unit 60 while passing through the condenser 50, thereby causing moisture contained in the circulating hot air to be condensed.

The cooling unit 60 includes a suction path 61, an exhaust path 62 and a cooling fan 63. One end of the suction path 61 is connected to suction slits (17, see FIG. 1) formed at a front lower side, for example, of the body 10, and the other end of the suction path 61 is connected to a suction side of the cooling fan 63. One end of the exhaust path 62 is connected to a discharge side of the cooling fan 63. The exhaust path 62 extends toward the hot-air circulating-path 46, and the condenser 50 is located at a meeting point of the exhaust path 62 and hot-air circulating-path 46. As shown in FIG. 3, the suction path 61 and exhaust path 62 may be integrated with the base assembly 70.

The condenser 50 is configured such that hot air that circulates through the hot-air circulating-path 46 of the drying unit 40 and cold air that flows along the exhaust path 62 of the cooling unit 60 exchange heat with each other while being isolated from each other. For this, the condenser 50 has a plurality of partitions 52 stacked with a predetermined interval to define heat-exchange paths 51.

The heat-exchange paths 51 include condensing paths 51*a* in communication with the connecting duct 45 and the hot-air circulating-path 46, through which the circulating hot air passes, and cooling paths 51*b* in communication with the exhaust path 62, through which cooling air passes. The condensing paths 51*a* and cooling paths 51*b* are isolated from each other and are alternately arranged to intersect each other. The cooling paths 51*b* may be provided with a fin structure 53 to improve heat-exchange efficiency of the condenser 50.

The condenser 50 may be detachably mounted to the base assembly 70 via a condenser mounting hole 72 formed at a front side of the base assembly 70 and a condenser mounting hole (13*a*, see FIG. 1) formed in the front panel 13 at a lower position corresponding to the condenser mounting hole 72. The condenser mounting hole 13*a* of the front panel 13 is opened or closed by a cover (13*b*, see FIG. 1).

If a drying operation begins, the drive motor 31 and the heater 42 are operated. The circulating fan 43 is rotated by the drive motor 31, creating airflow. The heater 42 heats air passing through the heating duct 41. The air, heated in the heating duct 41, is introduced into the rotating drum 20 through the hot-air inlet holes 22. As the heated hot air removes moisture from an object to be dried that is previously put into the rotating drum 20, the drying of the object is accomplished. Then, the resulting hot and humid air within the rotating drum 20 is circulated to the condenser 50 through the hot-air discharge duct 44 and the connecting duct 45. The air, directed into the condenser 50, is cooled and is deprived of moisture while passing through the condensing paths 51*a* of the condenser 50. In this way, the dried air is circulated to the heating duct 41 through the hot-air circulating-path 46 and is again heated by the heater 42 so as to be supplied into the rotating drum 20.

Power of the drive motor 31 is transmitted to the rotating drum 20 via the belt 33, to rotate the drum 20. Rotation of the drum 20 causes movement of the object to be dried, allowing the object to be uniformly dried.

The drive motor 31 also rotates the cooling fan 63. When the cooling fan 63 is rotated, outside air is suctioned into the body 10 through the suction slits 17 and is guided to the condenser 50 through the paths 61 and 62 defined in the base assembly 70. The air, guided into the condenser 50, is relatively cold and serves to cool the hot air passing through the condensing paths 51*a* of the condenser 50 while passing through the cooling paths 51*b*. Then, the used air is discharged to the outside through exhaust slits (18, see FIG. 1) formed at the body 10.

Condensate water, generated in the above-described drying operation, as shown in FIG. 3, is collected in a condensate water sump 73 provided in the base assembly 70. Once being collected in the condensate water sump 73, the condensate water is pumped by a pump 81 so as to be guided into the water tank 200 through a condensate-water discharge pipe 82 and be stored in the water tank 200.

Figure 4:
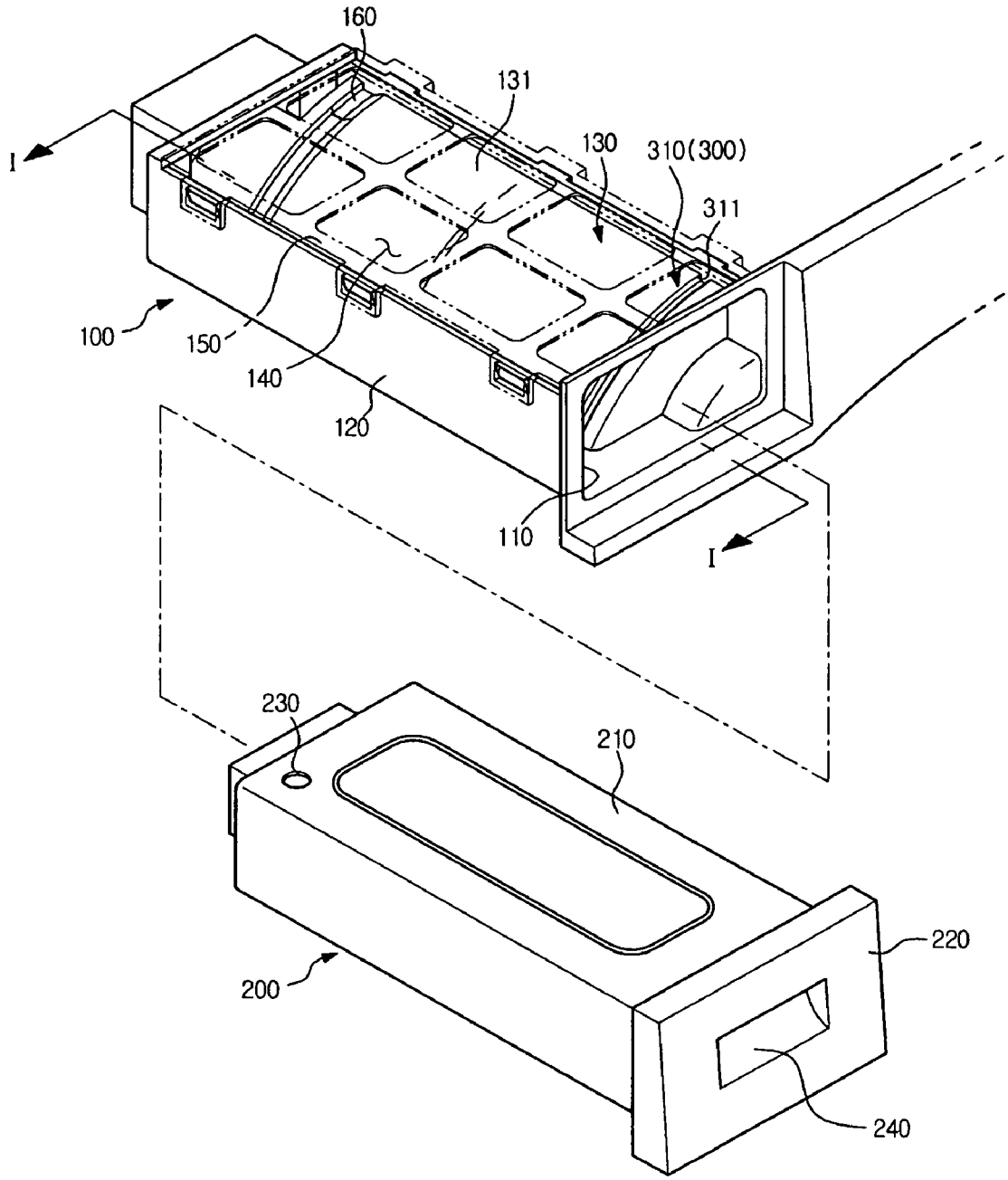
FIG. 4 is a perspective view illustrating a water tank housing and water tank of the clothes dryer in accordance with the embodiment.

FIG. 4 is a perspective view illustrating the water tank housing and water tank of the clothes dryer in accordance with the embodiment.

As shown in FIGS. 1 and 4, the water tank housing 100 includes a housing entrance 110, through which the water tank 200 enters or exits, and a water tank receptacle 140 defined by both side plates 120 and a bottom plate 130. A protective panel 150 may be installed to the top of the water tank receptacle 140 to protect the water tank 200. As shown in FIG. 4, the bottom panel 130 of the water tank housing 100 may partially curved convexly, in order to prevent the water tank housing 100 from interfering with the rotating drum 20 located therebelow. Accordingly, when the water tank housing 100 is located at a position not interfering with the rotating drum 20, the bottom surface 131 of the water tank housing 100 may have a flat form.

The water tank 200 includes a water tank body 210 in which the condensate water is stored, and a front cover 220 provided at a front side of the water tank body 210.

The water tank 220 has a water inlet hole 230 formed in a location of an upper surface thereof. One end of the condensate-water discharge pipe (82, see FIG. 2) is disposed immediately above the water inlet hole 230. Thereby, the condensate water, directed via the condensate-water discharge pipe 82, falls from the condensate-water discharge pipe 82 and is introduced into the water tank 200 through the water inlet hole 230.

The front cover 220 is configured to cover the housing entrance 110 of the water tank housing 100 in a state in which the water tank 200 is mounted into the water tank housing 100. A handle 240 may be provided at a front surface of the front cover 220 to allow a user to easily grip the water tank 200.

When the drying operation is finished, or when the water tank 200 is filled with more than a predetermined level of water, the water tank 200 must be separated from the body 10 to empty the water tank 200. In the course of separating the water tank 200 from the body 10, a lower surface of the water tank 200 is supported by the bottom surface 131 of the water tank housing 100 and therefore, a user can easily pull out the water tank 200 from the body 10 with one hand. However, at a time when the water tank 200 is separated from the entrance 110 of the water tank housing 100, the weight of the water tank 200 is directly applied to the user, increasing a probability of dropping the water tank 200.

For this reason, the clothes dryer 1 of the present embodiment includes a safety guide to guide safe separation of the water tank 200.

Figure 5:
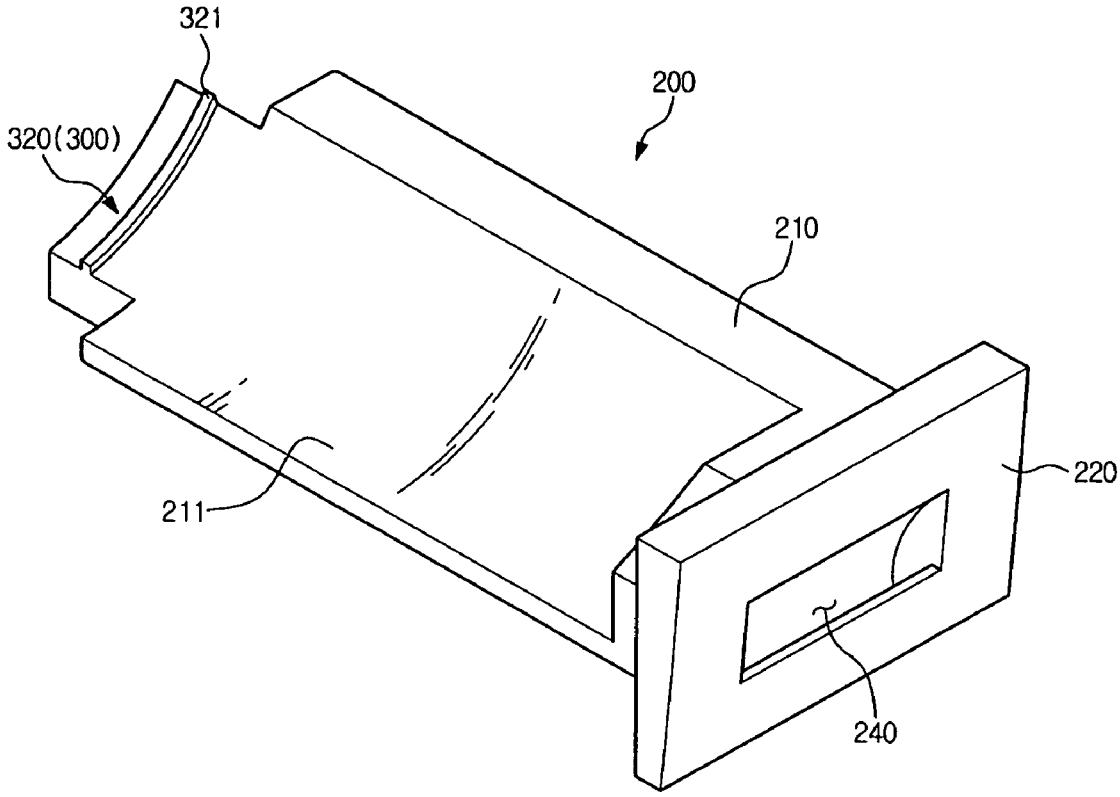
FIG. 5 is a perspective view illustrating an inversed state of the water tank shown in FIG. 4.
Figure 6:
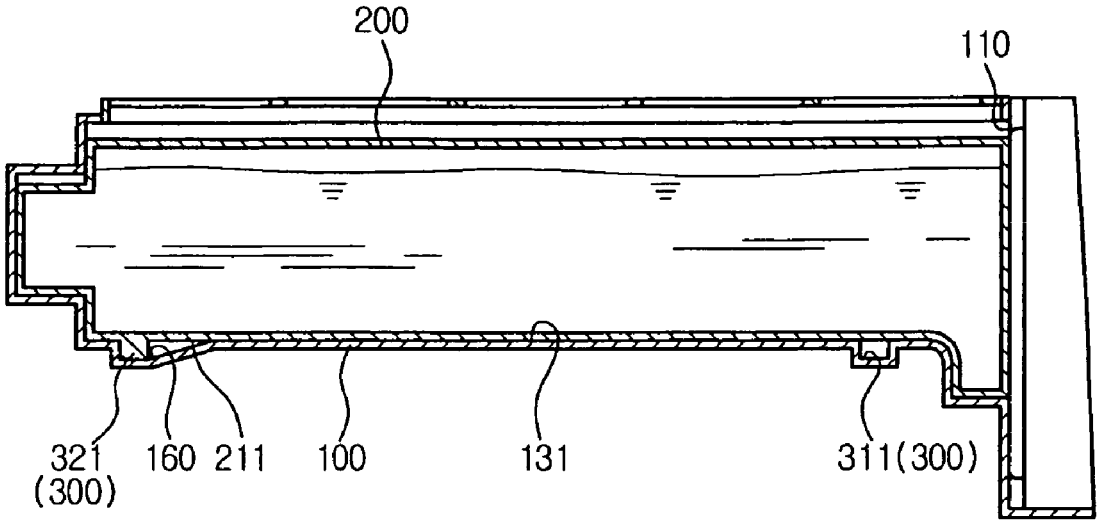
FIGS. 6 and 7 are sectional views taken along the line I-I of FIG. 4.
Figure 7:
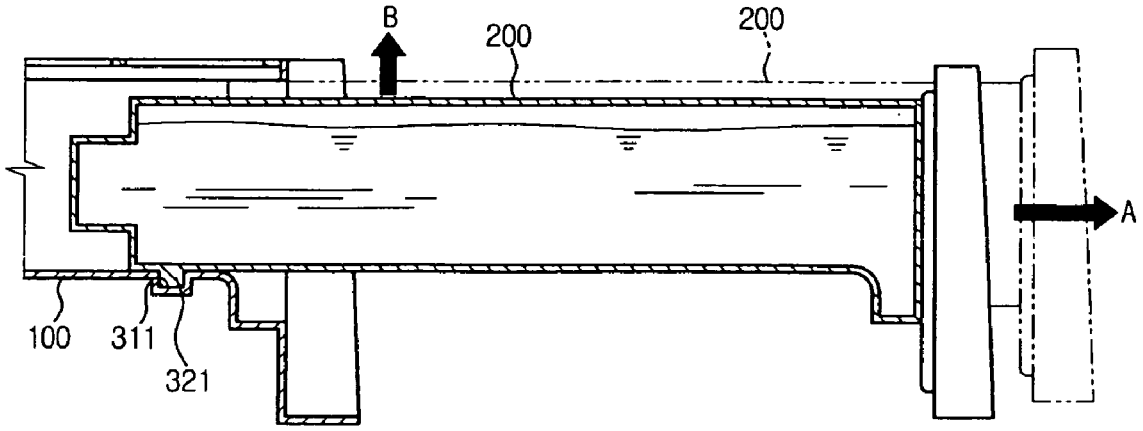

FIG. 5 is a perspective view illustrating an inversed state of the water tank shown in FIG. 4, and FIGS. 6 and 7 are sectional views taken along line I-I of FIG. 4. Specifically, FIG. 6 illustrates a state where the water tank 200 is mounted in the water tank housing 100, and FIG. 7 illustrates a state where the water tank 200 is being separated from the water tank housing 100. Hereinafter, the safety guide 300 will be described in detail with reference to FIGS. 4 to 7.

When the water tank 200 is separated from the water tank housing 100 in a first direction (designated by the arrow A, see FIG. 7), the safety guide 300 limits the movement of the water tank 200 in the first direction at a specific time point, and then allowing the user to apply a force to the water tank 200 in a second direction (designated by the arrow B, see FIG. 7) different from the first direction A. Specifically, the safety guide 300 limits the movement of the water tank 200 in the first direction at a specific time point to make it possible for the user to pull out the water tank 200 with a single continuous operation and then allow the user to move the water tank 200 in the second direction B using both hands. This can prevent a user accident due to the weight of the water tank 200.

The safety guide 300 includes a first stopper 310 provided at the water tank housing 100, and a second stopper 320 provided at the water tank 200 to correspond to the first stopper 310. If the second stopper 320 of the water tank 200 is engaged with the first stopper 310 of the water tank housing 100 during removal of the water tank 200, the movement of the water tank 200 in the first direction is limited. Then, if the user moves the water tank 200 in the second direction, engagement between the first stopper 310 and the second stopper 320 is released.

The first stopper 310 may be positioned adjacent to the housing entrance 110, and the second stopper 320 may be positioned at an end of the water tank 200 opposite the housing entrance 110.

The first stopper 310 may take the form of an indentation 311 defined in the bottom surface 131 of the water tank housing 100, and the second stopper 320 may take the form of a protrusion 321 protruding from a lower surface 211 of the water tank 200. If the protrusion 321 is engaged with the indentation 311 in the course of the water tank 200 being forwardly pulled out from the body 10, the user has to grip the water tank 200 using both hands in order to completely pull out the water tank 200. That is, the user first slightly lifts the water tank 200 to release the engagement while gripping the water tank body 210 with one hand and gripping the handle 240 with the other hand, for example, and thereafter, again forwardly pulls out the water tank 200.

The water tank housing 100 may include a seating recess 160 defined therein for the protrusion 321 to prevent unwanted tilting of the water tank 200 mounted in the water tank housing 100.

In FIG. 6, although the seating recess 311 defined in the water tank housing 100 and the protrusion 321 of the water tank 200 are illustrated, a contrary configuration may be contemplated, in which a seating recess is defined in the water tank 200 and a protrusion is provided at the water tank housing 100.

Figure 8:
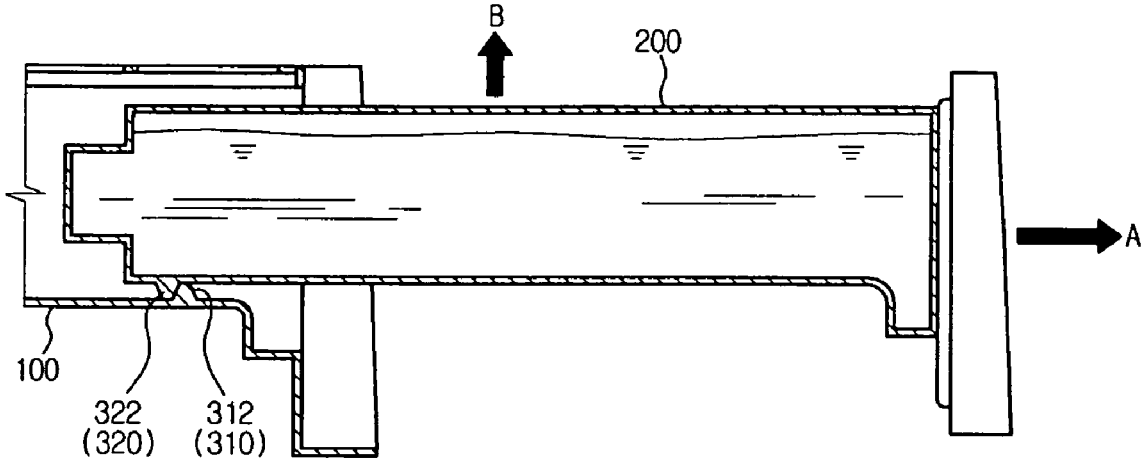
FIG. 8 is a view illustrating an alternative embodiment of a safety guide of the clothes dryer.

Alternatively, as shown in FIG. 8, the first stopper 310 of the water tank housing 100 may take the form of a first protrusion 312 protruding toward the water tank 200, and the second stopper 320 of the water tank 200 may take the form of a second protrusion 322 protruding toward the water tank housing 100.

Here, the number and shape of the indentation 311 and protrusions 321, 312 and 322 are not limited to the illustrations, and can be appropriately changed if necessary.

As apparent from the above description, the present embodiments provide a clothes dryer having an improved configuration to allow a user to pull out a water tank via a safe operation, eliminating a probability of a user accident during removal of the water tank.

Although embodiments have been shown and described, it would be appreciated by those skilled in the art that changes may be made in these embodiments without departing from the principles and spirit of the invention, the scope of which is defined in the claims and their equivalents.

What is claimed is:

1. A dryer, comprising:

a body having a water tank housing, the water tank housing having a housing entrance at a front side thereof;

a drying unit heating air to be circulated within the body to dry an object;

a water tank detachably mounted into the water tank housing to store water collected from the object to be dried, the water tank moveably mounted into the water tank housing to enter or to exit through the housing entrance; and a safety guide limiting movement of the water tank in a one direction for exiting the water tank when the water tank is separated from the water tank housing in the one direction;

wherein the water tank slides in the one direction a predetermined distance before the safety guide limits the movement of the water tank.

2. The dryer according to claim 1, wherein the safety guide includes a first stopper provided at the water tank housing, and a second stopper provided at the water tank and corresponding to the first stopper when the water tank is separated from the water tank housing in the one direction.

3. The dryer according to claim 2, wherein the first stopper is formed at a bottom surface of the water tank housing, and the second stopper is formed at a lower surface of the water tank.

4. The dryer according to claim 2, wherein:

the first stopper is positioned adjacent to the housing entrance.

5. The dryer according to claim 4, wherein the second stopper is positioned opposite the housing entrance prior to the water tank being separated from the water tank housing in the first direction.

6. The dryer according to claim 1, wherein the safety guide includes a protrusion protruding from the water tank toward the water tank housing, and at least one indentation defined within the water tank housing to be engaged with the protrusion when the water tank is separated from the water tank housing in the one direction to limit movement of the water tank.

7. The dryer according to claim 6, wherein a first indentation is formed at a position substantially adjacent to an entrance of the water tank housing and a second indentation is formed at a back portion of the water tank housing with respect to an entrance of the water tank housing.

8. The dryer according to claim 7, wherein the second indentation is a seating recess configured to receive the protrusion when the water tank is not separated from the water tank housing in the one direction, the seating recess preventing the water tank from tilting.

9. The dryer according to claim 1, wherein the limiting of movement by of the water tank in the one direction by the safety guide allows a user to disengage the water tank from the water tank housing in a upward direction.

10. A dryer, comprising:

a body having a water tank housing, the water tank housing having a housing entrance at a front side thereof;

a rotating drum rotatably installed in the body and configured to receive an object to be dried;

a drying unit heating air and circulating the heated air through the rotating drum;

a condenser disposed on a circulating route of the heated air condensing moisture contained in the air;

a cooling unit supplying cooling air to the condenser;

a water tank detachably mounted into the water tank housing to store condensate water, the water tank moveably mounted into the water tank housing to enter or to exit through the entrance; and a safety guide guiding the water tank to a predetermined position with respect to the water tank housing;

wherein the water tank slides in a one direction a predetermined distance before the safety guide directs the water tank to a predetermined position with respect to the water tank housing.

11. The dryer according to claim 10, wherein the safety guide includes a least one indentation formed in at least one of the water tank housing and the water tank.

12. The dryer according to claim 11, wherein:

the at least one indentation is formed in a bottom surface of the water tank housing; and the water tank includes a protrusion formed at a lower surface of the water tank to correspond to the indentation when the water tank is guided to the predetermined position.

13. The dryer according to claim 10, wherein the safety guide includes a protrusion formed on at least one of the water tank housing and the water tank.

14. The dryer according to claim 13, wherein the safety guide includes a first protrusion formed at a bottom surface of the water tank housing, and a second protrusion formed at a lower surface of the water tank.

15. The dryer according to claim 10, wherein after the water tank is moved to the predetermined position, the guide allows a user to pull out the water tank in a state of lifting the water tank upward.

16. A dryer, comprising:

a drying unit heating air to be circulated within the dryer to dry an object;

a water tank housing having a entrance at a front side thereof;

a water tank detachably mounted into the water tank housing, the water tank moveably mounted into the water tank housing to enter or to exit through the entrance;

an indentation formed in a bottom surface of the water tank housing at a position adjacent to an entrance of the water tank housing; and a protrusion formed on a lower surface of the water tank and configured to be engaged with the indentation when the water tank is separated from the water tank housing in one direction;

wherein the water tank slides in a one direction a predetermined distance before the protrusion formed on the lower side of the water tank engages the indention formed on the water tank housing.

17. A dryer, comprising:

a drying unit heating air to be circulated within the dryer to dry an object;

a water tank housing;

a water tank detachably mounted into the water tank housing;

a first protrusion provided at a bottom surface of the water tank housing at a position adjacent to an entrance of the water tank housing; and a second protrusion formed at a lower surface of the water tank and configured to interfere with the first protrusion when the water tank is separated from the water tank housing in one direction;

wherein the water tank slides in a one direction a predetermined distance before the first protrusion formed on the lower side of the water tank engages the second protrusion formed on the water tank housing.

18. A dryer, comprising:

a drying unit heating air to be circulated within the dryer to dry an object;

a water tank housing having a entrance at a front side thereof;

a water tank detachably mounted in the water tank housing to hold water, the water tank moveably mounted into the water tank housing to enter or to exit through the entrance, wherein the water tank housing configured to prevent the water tank from becoming completely disengaged in a one direction for exiting the water tank when the water tank is pulled out from within the water tank housing in the one direction after the water tank has been pulled out a predetermined distance.

* * * * *

UNITED STATES PATENT AND TRADEMARK OFFICE

CERTIFICATE OF CORRECTION

PATENT NO. : 8,393,090 B2
APPLICATION NO. : 12/457943
DATED : March 12, 2013
INVENTOR(S) : Min Hee Kang It is certified that error appears in the above-identified patent and that said Letters Patent is hereby corrected as shown below:

In the Claims:

Column 9, Line 27, Claim 16, delete “indention” and insert -- indentation --, therefor.

Signed and Sealed this
Thirteenth Day of August, 2013

Teresa Stanek Rea
*Acting Director of the United States Patent and Trademark Office*